US008839842B2

(12) United States Patent
Ashelin et al.

(10) Patent No.: US 8,839,842 B2
(45) Date of Patent: Sep. 23, 2014

(54) INSULATED WASHDOWN FLEXIBLE WALLS AND CURTAINS

(75) Inventors: Charles J. Ashelin, Dubuque, IA (US); David J. Hoffmann, Peosta, IA (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 59 days.

(21) Appl. No.: 13/278,883

(22) Filed: Oct. 21, 2011

(65) Prior Publication Data

US 2013/0098567 A1 Apr. 25, 2013

(51) Int. Cl.
*A47H 1/00* (2006.01)

(52) U.S. Cl.
USPC ..... 160/330; 160/40; 52/404.5

(58) Field of Classification Search
USPC ..... 160/330, 40, 230, 232, 236; 52/309.9, 52/404.5, 406.1, 406.2, 407.1, 407.2, 52/DIG. 13; 181/287
See application file for complete search history.

(56) References Cited

U.S. PATENT DOCUMENTS

| | | | | | |
|---|---|---|---|---|---|
| 1,890,906 | A | | 12/1932 | Harney | |
| 2,495,414 | A | * | 1/1950 | Herrington | 219/201 |
| 3,372,729 | A | | 3/1968 | Lindenmayer | |
| 3,628,626 | A | * | 12/1971 | Merrill | 181/290 |
| 3,856,072 | A | | 12/1974 | Sund | |
| 4,083,395 | A | * | 4/1978 | Romano | 160/199 |
| 4,193,474 | A | * | 3/1980 | Okubo et al. | 181/287 |
| 4,304,824 | A | | 12/1981 | Karpinski | |
| 4,335,774 | A | * | 6/1982 | Price | 160/84.06 |
| 4,391,865 | A | * | 7/1983 | Constance | 428/74 |
| 4,426,819 | A | * | 1/1984 | Dyar | 52/407.2 |
| 4,437,505 | A | | 3/1984 | Rodgers | |
| 5,070,924 | A | * | 12/1991 | Bateman | 160/124 |
| 5,490,567 | A | | 2/1996 | Speer | |

(Continued)

FOREIGN PATENT DOCUMENTS

| | | |
|---|---|---|
| EP | 2065076 A1 | 6/2009 |
| GB | 2174336 | 11/1986 |
| WO | 0118345 | 3/2001 |
| WO | 0216125 | 2/2002 |

OTHER PUBLICATIONS

International Searching Authority, "International Search Report," issued in connection with application serial No. PCT/US2012/059746, mailed Mar. 20, 2013, 4 pages.

(Continued)

*Primary Examiner* — Blair M. Johnson
(74) *Attorney, Agent, or Firm* — Hanley, Flight & Zimmerman, LLC

(57) ABSTRACT

Example insulated dividers, such as curtain-doors and temporary walls for dividing areas of a building, include features that make the dividers particularly suited for food and drug related environments that demand cleanliness and require dividers to be periodically washed down to remove microorganisms and other contaminants. Some example dividers include a touch-and-hold fastener to hold a flexible insulated pad within an internal space of a pliable hollow panel. In some examples, the insulated pad is made of polyester batting with loops of fiber to which the hook portion of the touch-and-hold fastener can engage. In some examples, both the insulated pad and the touch-and-hold fastener are completely contained within the hollow panel so that neither the pad nor the fastener provides an exposed external surface for harboring microorganisms. In some examples, the pliable panel's outer peripheral edge is hermetically sealed by thermal bonding, heat sealing, welding and/or ultrasonic joining.

26 Claims, 4 Drawing Sheets

(56) References Cited

U.S. PATENT DOCUMENTS

| | | | | |
|---|---|---|---|---|
| 5,816,016 | A * | 10/1998 | Zarnick | 52/747.1 |
| 6,358,591 | B1 | 3/2002 | Smith | |
| 6,446,751 | B1 * | 9/2002 | Ahuja et al. | 181/295 |
| 7,686,062 | B1 * | 3/2010 | Darnell | 160/330 |
| 2004/0187185 | A1 * | 9/2004 | David | 2/69 |
| 2007/0277941 | A1 | 12/2007 | Jansen et al. | |
| 2007/0277943 | A1 | 12/2007 | Boerger et al. | |
| 2008/0110580 | A1 | 5/2008 | Hoerner et al. | |
| 2009/0140097 | A1 | 6/2009 | Collier et al. | |
| 2010/0083417 | A1 * | 4/2010 | Alder et al. | 2/69 |

OTHER PUBLICATIONS

International Searching Authority, "Written Opinion of the International Searching Authority," issued in connection with application serial No. PCT/US2012/059746, mailed Mar. 20, 2013, 6 pages.

International Bureau, "International Preliminary Report on Patentability," issued in connection with International patent application No. PCT/US2012/059746, issued Apr. 22, 2014, 6 pages.

* cited by examiner

INSULATED WASHDOWN FLEXIBLE WALLS AND CURTAINS

FIELD OF THE DISCLOSURE

This patent generally pertains to insulated curtains and insulated temporary walls and, more specifically, to insulated washdown flexible walls and curtains.

BACKGROUND

Curtains and/or temporary walls can be installed across doorways or installed within a building to separate one area from another. In some cases, such curtains include an insulated pad sandwiched between two outer layers of fabric. Quilting or other sewing methods have been used for holding the pad in place between the fabric layers. Such construction, however, may not be suitable in some situations, particularly in food and drug related environments that demand cleanliness and require many surfaces to be periodically washed down and sanitized to remove microorganisms and/or other contaminants.

DETAILED DESCRIPTION

FIGS. 1-10 show various examples of dividers 10*a-j*. The dividers 10*a-j* can be used in various applications including, but not limited to, dividing a first building space 12 from a second building space 14. The term, "building space" means any area associated with a building. Examples of a building space include, but are not limited to, a room, a hallway, a cold storage compartment, any area inside of a building, an area just outside of a building, a loading dock (e.g., between an interior side and an exterior side), etc.

Figure 1:
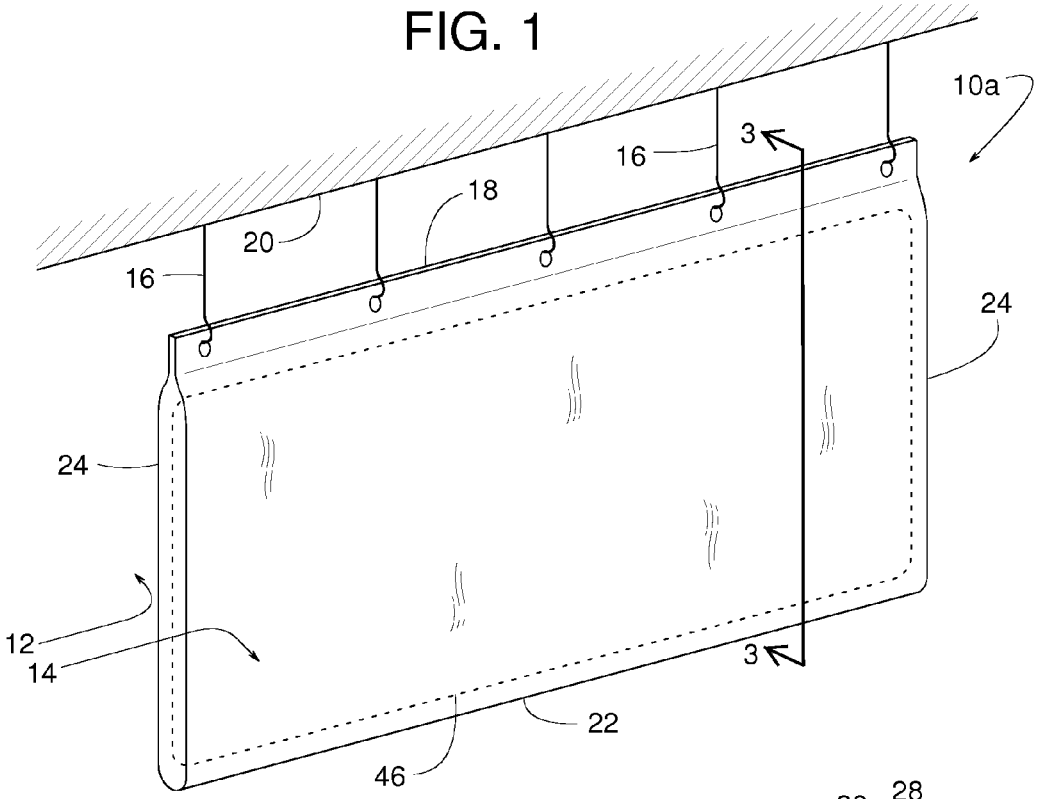
FIG. 1 is a perspective view of an example divider disclosed herein implemented as a door.

Dividers 10*a-j* can be installed in various configurations. As shown in FIG. 1, for example, divider 10*a* is a temporary wall with a plurality of suspension fasteners 16 (e.g., hangers, cables, straps, hooks, snaps, clips, screws, eyebolts, etc. and/or various combinations thereof) attached to an upper edge 18 of divider 10*a* for suspending divider 10*a* from an overhead support member 20 (e.g., a cable, beam, ceiling, rafter, joist, etc.). In some examples, a lower edge 22 of divider 10*a* is further anchored to the building's floor and/or other anchor point (e.g., a lower cable, an anchor bolt, an upper edge of another divider adjacent the divider 10*a*, etc.).

In some examples, one or both lateral edges 24 of divider 10*a* are anchored to an anchor point (e.g., a wall, a post, a lateral edge of another divider adjacent divider 10*a*, etc.). In some examples, interconnecting adjacent edges of multiple dividers 10*a* creates a cumulatively larger divider comprising multiple interconnected dividers 10*a*. Such interconnection of adjacent divider edges (e.g., horizontal and/or vertical edges) is accomplished using various edge connectors, examples of which include, but are not limited to, a tongue-in-groove connector (e.g., ZIPLOCK, trademark of S. C. Johnson & Son, Inc. of Racine, Wis.), a zipper, touch-and-hold or hook-and-loop connector (e.g., VELCRO, trademark of Velcro USA Inc. of Manchester, N.H.), a clip, a snap, etc.

Figure 2:
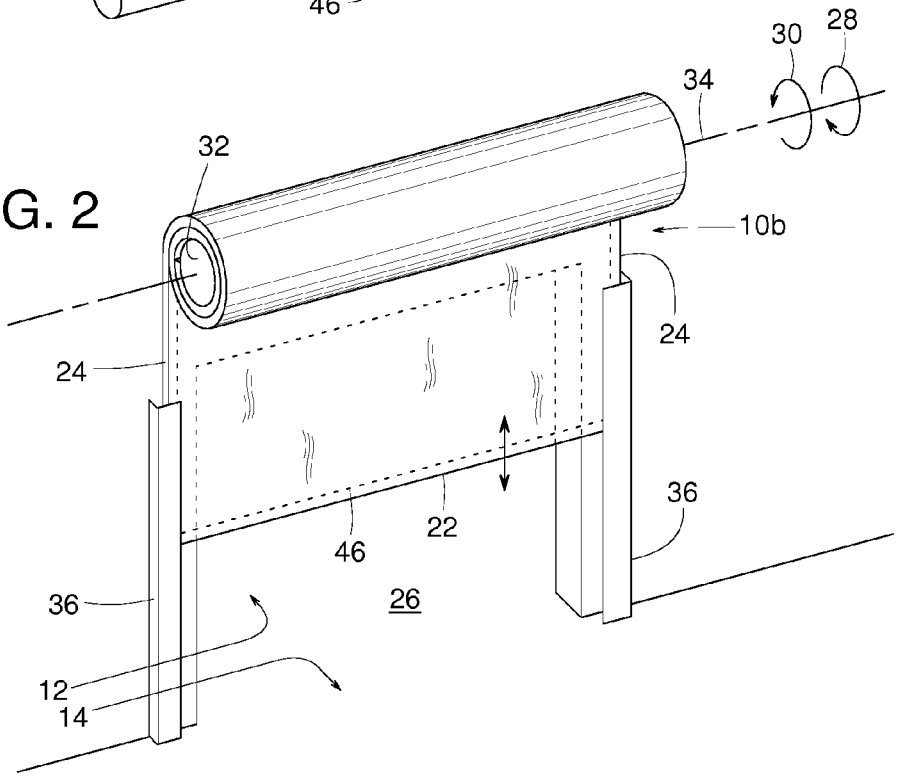
FIG. 2 is a perspective view of an example divider disclosed herein for separating one building space from another.

In another example shown in FIG. 2, divider 10*b* is a rollup door that is to move relative to a doorway 26. In this example, divider 10*b* is sufficiently pliable to be selectively rolled and unrolled in a shape-restorable manner (i.e., restorable in that divider 10*b* substantially recovers to its original shape). To facilitate rolling and unrolling of divider 10*b*, in some examples, divider 10*b* is wrapped or wound about a drum 32 that is rotatable (e.g., manually or powered) about an axis 34 in directions 28 and 30 to selectively open and close the door employing divider 10*b*. In other examples, when a door employing divider 10*b* is open, an overhead panel-storage track holds divider 10*b* in a coiled arrangement and/or some other configuration (e.g., an S-configuration). Some examples of such overhead panel-storage tracks include, but are not limited to, straight tracks, scroll shaped tracks, tracks per US Published Patent Application US 2007/0277943A1, tracks per US Published Patent Application US 2007/0277941A1, etc.). U.S. Patent Publications 2007/0277943A1 and US 2007/0277941A1 are hereby incorporated by reference in their entireties. In some examples, a pair of wall-mounted tracks 36 helps seal and/or guide lateral edges 24 of divider 10*b*.

Figure 3:
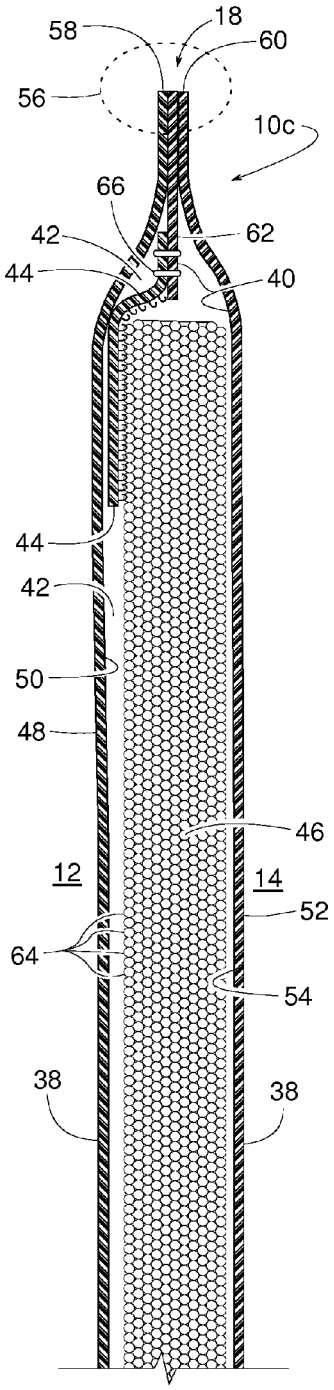
FIG. 3 is a cross-sectional view of another example divider disclosed herein taken along line 3-3 of FIG. 1 but showing the divider constructed per one of several examples disclosed herein.

Construction details of dividers 10*a* and 10*b* may vary. In some examples, dividers 10*a* and 10*b* incorporate one or more features of dividers 10*c-j*, which are illustrated in FIGS. 3-10, respectively. The features of the dividers 10*c-j* may be used for many applications. For example, the example dividers and/or the features of the dividers may be used in food and drug related environments, which often require, for example, surfaces to be periodically washed down and/or sanitized to remove microorganisms and other contaminants. In such instances, for example, supporting internal insulation pads and sealing of the divider's outer seams without the use of joints or seams (e.g., a sewn joint) can significantly help reduce (e.g., minimize) areas where microorganisms, bacteria and/or other contaminates can occur. FIG. 3 shows divider 10*c* having a hollow panel 38 with an internal surface 40 defining an internal space 42 within panel 38. A touch-and-hold fastener 44 connects an insulated pad 46 to the internal surface 40 of panel 38. In some examples, both the insulated pad 46 and the touch-and-hold fastener 44 are completely contained within the hollow panel 38 so that neither the pad 46 nor the fastener 44 provides an exposed external surface. As used herein, the term, "touch-and-hold fastener" means, for example, any device or fastener providing a connection upon exerting sufficient contact pressure to make the connection. Examples of a touch-and-hold fastener include, but are not limited to, a VELCRO fastener and/or portions thereof (e.g., the hook portion or the loop portion), a hook-and-loop fastener and/or portions thereof (e.g., the hook portion or the loop portion), adhesive tape, etc. The term, "insulated pad"

means, for example, any member with open cavities, closed cavities, or porosity for at least temporarily trapping a gas (e.g., air), wherein the trapped gas reduces the member's thermal conductivity. Examples of insulated pad 46 include, but are not limited to, an open-cell foam block, a closed-cell foam block, resiliently compressible foam (e.g., polyurethane foam), fiber batting (e.g. polyester batting), etc. Internal surface 40 refers to any material exposed to the internal hollow space 42 within panel 38.

Still referring to FIG. 3, in some examples, hollow panel 38 includes a first pliable sheet 48 defining a first internal surface 50, a second pliable sheet 52 defining a second internal surface 54 and a substantially hermetically sealed joint 56 coupling a first edge 58 of first sheet 48 and a second edge 60 of second sheet 52. As used herein, the term, "pliable" as it relates to a sheet means, for example, a handheld sample of the sheet can be readily crumpled by hand and subsequently restored by hand substantially back to the sheet's original approximate shape without appreciable permanent damage to the sheet. Example materials for such a sheet include, but are not limited to, vinyl, rubber impregnated fabric, plastic coated canvas duck, etc. In some examples, sheets 48 and 52 are two separate pieces subsequently joined along their outer peripheral edges. In other examples, sheets 48 and 52 are a single or unitary sheet of material folded in half, where the halves are subsequently joined along their outer peripheral edge. However, in some examples, the folded crease provides a section of peripheral edge that is not subsequently joined because the folded crease already provides a hermetically sealed edge.

Joint 56 can be at various locations on panel 38, wherein examples of such locations include being on the panel's upper edge 18, lower edge 22 (FIG. 1), and/or one or more lateral edges 24 (FIG. 1), where edges 18, 22 and 24 are examples of the panel's outer peripheral edge. The expression, "substantially hermetically sealed" refers to a joint where all or nearly the entire length of the joint is impervious to liquid (e.g., water). Substantially hermetically sealed, however, does not necessarily mean that the entire internal space 42 is completely sealed (e.g., an airtight seal), although that is the case in some examples. In other examples, however, internal space 42 is vented (e.g., forcibly or passively). For example, the internal space 42 may be vented for various reasons including, but not limited to, the "curtain bloating" problem addressed in US Published Patent Application US 2008/0110580A1, which is hereby incorporated by reference in its entirety.

Example divider 10*c* of FIG. 3 also includes an intermediate piece 62 that couples touch-and-hold fastener 44 to joint 56. In some examples, intermediate piece 62 and touch-and-hold fastener 44 run substantially the full horizontal length of upper edge 18 and suspend pad 46 therefrom. The use of intermediate piece 62 for connecting fastener 44 to joint 56, rather than connecting fastener 44 to joint 56 directly, prevents any porosity or irregular surfaces of touch-and-hold fastener 44 from introducing externally exposed microorganism-holding crevices to joint 56. In the example illustrated in FIG. 3, touch-and-hold fastener 44 is the hook portion of a hook-and-loop fastener, and the loop portion of the hook-and-loop fastener is provided by a plurality of loops 64 disposed on insulated pad 46. Such loops 64, for example, are a property characteristic and/or naturally exist in fiber batting. For example, fiber batting includes loops of fiber to which a hook portion of the touch-and-hold fastener 44 can engage. Thus pad 46 in the form of fiber batting works particularly well in this example.

Various types of connectors may be employed to couple touch-and-hold fastener 44 and intermediate piece 62, for connecting intermediate piece 62 to joint 56, and/or for connecting edges 58 and 60 at joint 56. In some examples, sewn stitches 66 connect touch-and-hold fastener 44 to intermediate piece 62. To connect intermediate piece 62 to joint 56 and to hermetically complete joint 56, edges 58 and 60 and the upper edge of intermediate piece 62 are, in some examples, thermally bonded together (e.g., heat sealed, welded, ultrasonically joined, etc.). So, in some examples, hermetically sealed joint 56 comprises a thermoplastic material. Such thermal plastic material can be at various points of joint 56, examples of such points include, but are not limited to, thermal plastic material incorporated within intermediate piece 62, sheets 48 and/or 52 being comprised of thermal plastic material, a thermal plastic coating on sheets 48 and/or 52, etc.

Figure 4:
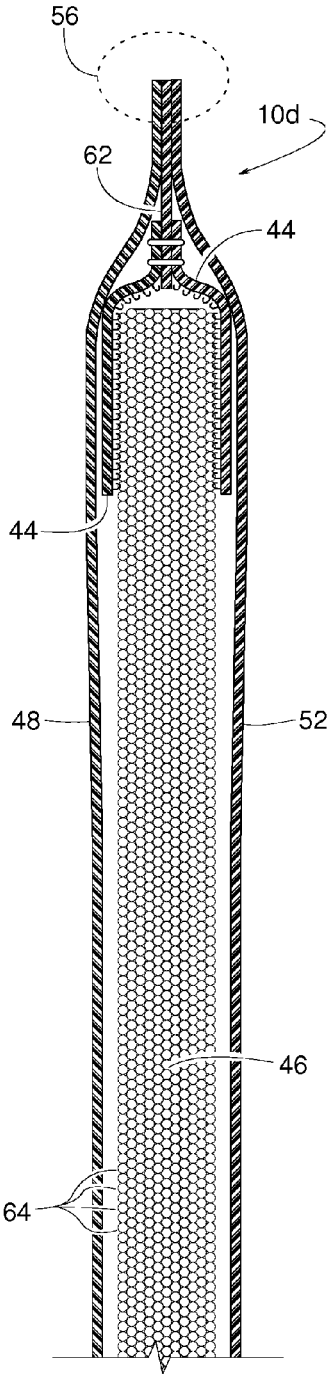
FIG. 4 is a cross-sectional view similar to FIG. 3 but showing another example divider disclosed herein.
Figure 5:
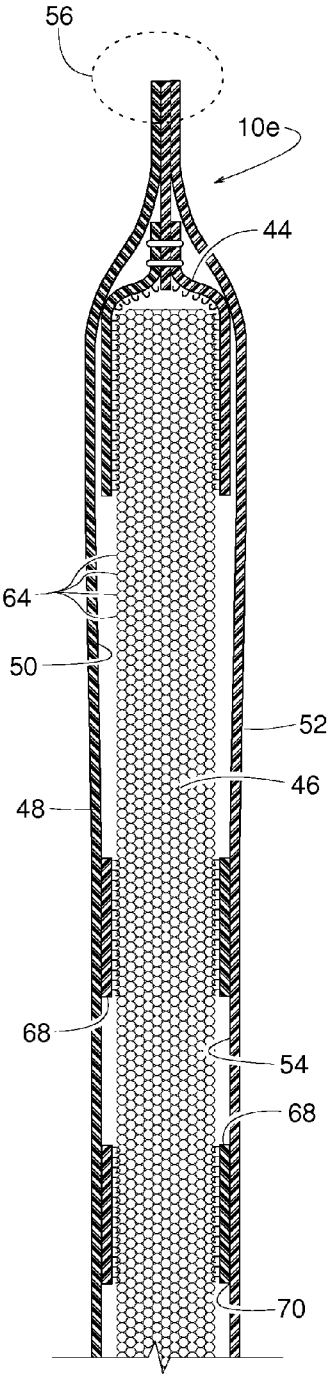
FIG. 5 is a cross-sectional view similar to FIG. 3 but showing another example divider disclosed herein.

FIGS. 4 and 5 show examples of means for providing pad 46 with additional support within the space between sheets 48 and 52. FIG. 4, for example, shows divider 10*d* having two touch-and-hold fasteners 44 both of which are sewn to intermediate piece 62, and couple or hook onto loops 64 of pad 46. Additionally or alternatively, FIG. 5 shows divider 10*e* with one or more secondary touch-and-hold fasteners 68 (e.g., hook portions) for supporting pad 46. One face of fasteners 68 has an adhesive coating 70 that couples or sticks to internal surfaces 50 and/or 54 of sheets 48 and/or 52, respectively. On the opposite face, fasteners 68 have hooks that hook onto loops 64, thereby coupling or holding pad 46 to the sheet's internal surfaces 50 and/or 54.

Figure 6:
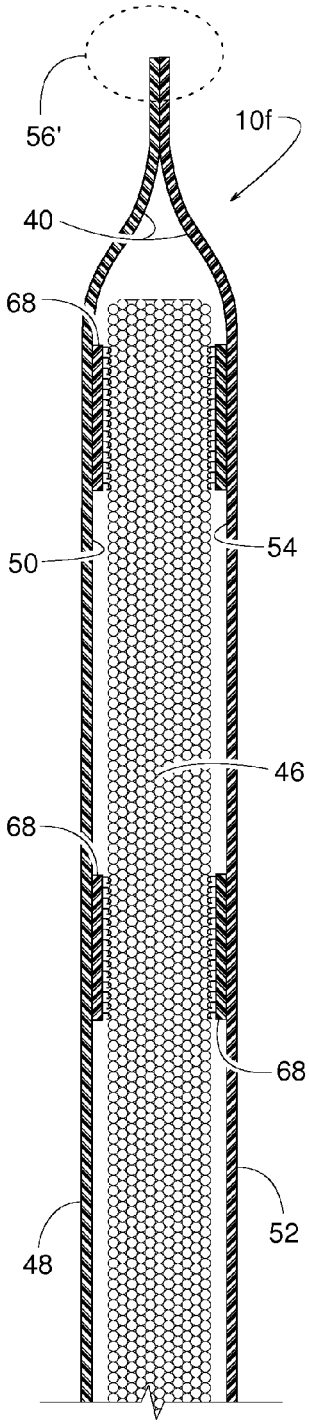
FIG. 6 is a cross-sectional view similar to FIG. 3 but showing another example divider disclosed herein.
Figure 7:
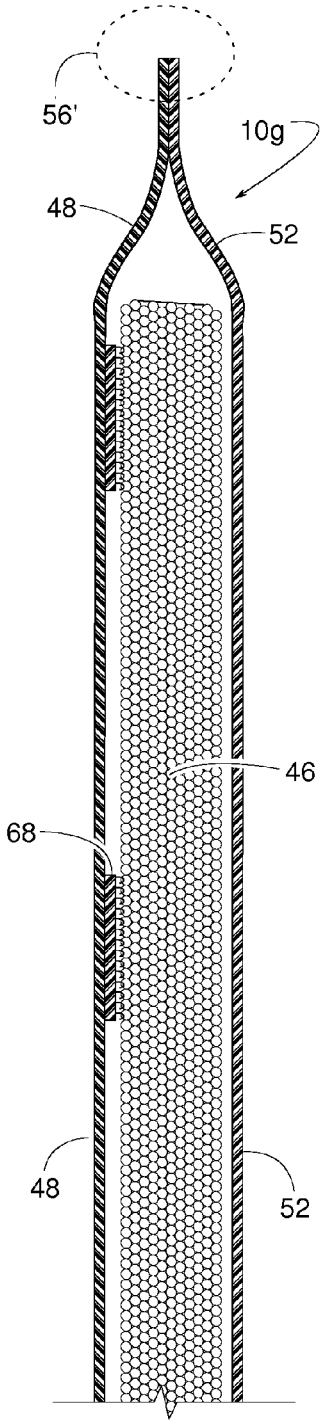
FIG. 7 is a cross-sectional view similar to FIG. 3 but showing another example divider disclosed herein.

In the examples shown in FIGS. 6 and 7, intermediate piece 62 and touch-and-hold fasteners 44 of the example dividers 10*c*-10*e* of FIGS. 3-5 are omitted. Instead, to support pad 46, divider 10*f* of FIG. 6 includes secondary fasteners 68 that couple or hold pad 46 to internal surfaces 50 and 54. Divider 10*g* of FIG. 7 is similar to divider 10*f*; however, secondary fasteners 68 of divider 10*g* are disposed on only one side of pad 46, which may be beneficial in a rollup door (e.g., such as shown in FIG. 2) where some relative translation might occur between sheets 48 and 52. In the examples of FIGS. 6 and 7, and in the example of FIG. 10 as well, sheets 48 and 52 are hermetically sealed at a joint 56'.

Figure 8:
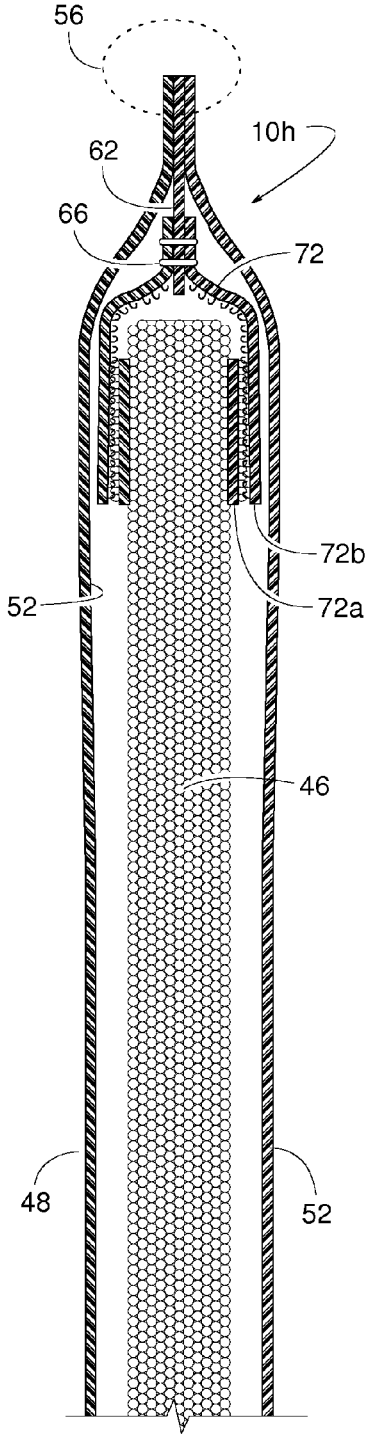
FIG. 8 is a cross-sectional view similar to FIG. 3 but showing another example divider disclosed herein.

Divider 10*h* of FIG. 8 is similar to divider 10*d* of FIG. 4; however, divider 10*h* includes a touch-and-hold fastener 72 that comprise both a hook portion and a loop portion. Fastener 72 having both hook and loop portions can be particularly useful in examples where pad 46 does not include loops 64, which may be the case when pad 46 is foam rather than batting or in cases where the batting has inadequate loops. In the illustrated example, one portion 72*a* of fastener 72 is attached to pad 46 by some suitable means (e.g., sewing, hooks, barbs, adhesively bonding, etc.), and the other portion 72*b* of fastener 72 is attached to intermediate piece 62 by some suitable means (e.g., sewn stitches 66, glue, etc.). In some examples, portion 72*a* is the hook portion of fastener 72, and portion 72*b* is the mating loop portion of fastener 72. In other examples, portion 72*b* is the hook portion of fastener 72, and portion 72*a* is the mating loop portion of fastener 72.

Figure 9:
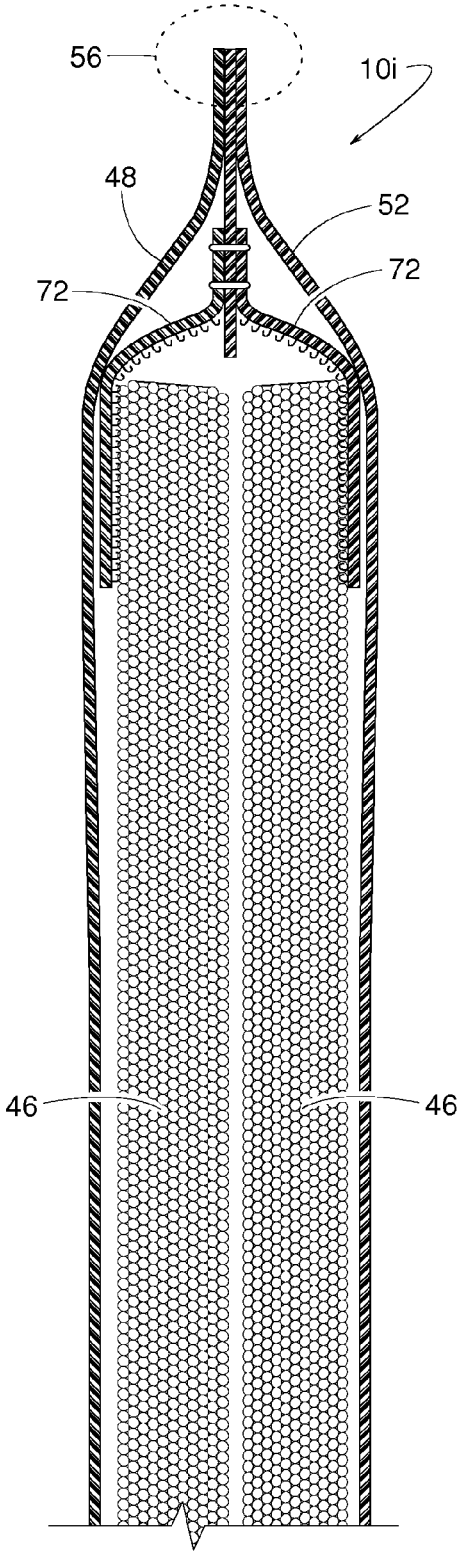
FIG. 9 is a cross-sectional view similar to FIG. 3 but showing another example divider disclosed herein.
Figure 10:
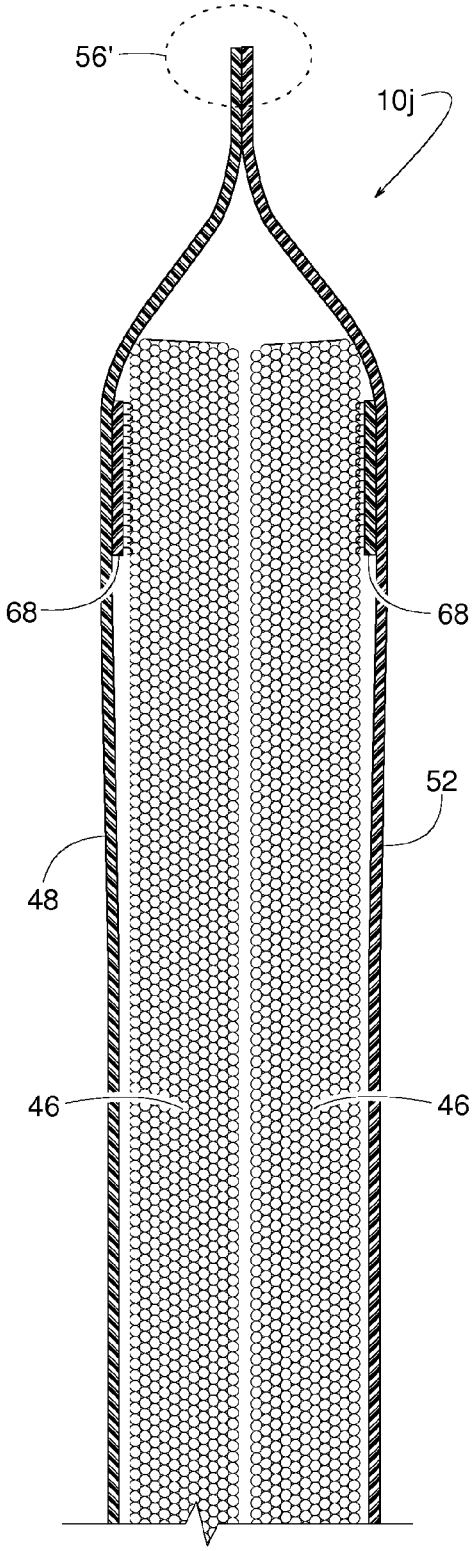
FIG. 10 is a cross-sectional view similar to FIG. 3 but showing another example divider disclosed herein.

FIGS. 9 and 10 show example dividers 10*i* and 10*j* each of which includes a plurality of insulated pads 46. Pads 46 of FIG. 9 are held or coupled within divider 10*i* using touch-and-hold fasteners 72 in a manner similar to that shown in FIG. 8. Pads 46 of FIG. 10 are held or coupled within divider 10*j* using touch-and-hold fasteners 68 in a manner similar to that shown in FIG. 6.

Although certain example methods, apparatus and articles of manufacture have been described herein, the scope of the coverage of this patent is not limited thereto. On the contrary, this patent covers all methods, apparatus and articles of manufacture fairly falling within the scope of the appended claims either literally or under the doctrine of equivalents.

The invention claimed is:

1. A divider to divide a first building space from a second building space, the divider comprising:

a pliable panel having an internal surface, the panel having peripheral edges that are joined to define an enclosed internal cavity of the panel;

an intermediate piece having a first end joined to the peripheral edges and a second end disposed within the internal cavity;

an insulated pad disposed within the internal cavity; and a touch-and-hold fastener suspended within the internal cavity from the second end of the intermediate piece, the touch-and-hold fastener to couple the insulated pad to the internal surface of the panel via the intermediate piece.

2. The divider of claim 1, wherein the touch-and-hold fastener is completely contained in its entirety within the internal cavity of the panel.

3. The divider of claim 1, wherein the insulated pad includes a plurality of loops to provide a portion of the touch-and-hold fastener.

4. The divider of claim 1, wherein the hollow panel is sufficiently pliable to be selectively and restorably rolled and unrolled.

5. The divider of claim 1, wherein the joint comprises a thermoplastic material.

6. The divider of claim 1, wherein the joined peripheral edges seal the enclosed cavity from an outer surface of the panel.

7. A divider to divide a first building space from a second building space, the divider comprising:

a hollow flexible panel having opposing inner surfaces defining at least a portion of an internal space within the hollow panel;

an intermediate piece positioned within the internal space having a free end spaced from the opposing inner surfaces of the panel;

an insulated pad disposed within the internal space;

a hook-and-loop fastener disposed on the intermediate piece within the internal space to suspend the insulated pad within the internal space.

8. A divider to divide a first building space from a second building space, the divider comprising:

a hollow pliable panel having an internal surface defining an internal space within the hollow panel;

an insulated pad disposed within the internal space;

an intermediate piece extending from the internal surface; and a touch-and-hold fastener suspended within the internal space via the intermediate piece to couple the insulated pad to the internal surface of the hollow panel, wherein the touch-and-hold fastener is substantially sealed within the hollow panel.

9. The divider of claim 8, wherein the insulated pad includes a plurality of loops to provide a portion of the touch-and-hold fastener.

10. A divider to divide a first building space from a second building space, the divider comprising:

a first flexible sheet comprising a first internal surface, a first exterior surface and a first edge, the first exterior surface to face the first building space;

a second flexible sheet comprising a second internal surface, a second exterior surface and a second edge, the second exterior surface to face the second building space and the first internal surface to face the second internal surface;

a joint coupling the first edge of the first sheet to the second edge of the second sheet;

an insulated pad disposed in an internal space defined between the first sheet and the second sheet;

a hook-and-loop fastener disposed in the internal space to couple the insulated pad to at least one of the first sheet and the second sheet; and an intermediate piece to suspend the hook-and-loop fastener from the joint.

11. The divider of claim 10, wherein the hook-and-loop fastener includes a loop portion and a hook portion that are separably joinable to each other, at least one of the loop portion or the hook portion attached to the insulated pad, and at least one of the loop portion or the hook portion coupled to the intermediate piece.

12. The divider of claim 10, wherein the insulated pad includes a plurality of loops to provide a portion of the hook-and-loop fastener.

13. The divider of claim 12, wherein the insulated pad comprises fiber batting.

14. The divider of claim 10, wherein the insulated pad comprises a foam material.

15. The divider of claim 10, wherein the hook-and-loop fastener is spaced apart from the joint.

16. The divider of claim 10, wherein the insulated pad is one of a plurality of insulated pads, the pads in the plurality of insulated pads being substantially parallel to each other and being substantially parallel to the first sheet and the second sheet.

17. The divider of claim 10, wherein the hook-and-loop fastener is one of a plurality of hook-and-loop fasteners, the fasteners in the plurality of hook-and-loop fasteners being spaced apart from each other, and the hook-and-loop fasteners of the plurality of hook-and-loop fasteners to couple the insulated pad to at least one of the first sheet or the second sheet.

18. The divider of claim 10, wherein the first sheet and the second sheet render the divider sufficiently pliable to be selectively rolled and unrolled in a shape-restorable manner.

19. The divider of claim 10, further comprising:

an upper edge that includes at least one of the first edge and the second edge;

an overhead support member disposed above the upper edge; and a suspension fastener attached to at least one of the first sheet and the second sheet and being in proximity with the upper edge, the suspension fastener to couple at least one of the first sheet and the second sheet to the overhead support member.

20. The divider of claim 10, wherein the joint comprises a thermoplastic material.

21. A divider of claim 10, wherein the joint is substantially hermetically sealed.

22. A divider to divide a first building space from a second building space, the divider comprising:

a first pliable sheet comprising a first internal surface, a first exterior surface and a first edge, the first exterior surface to face the first building space;

a second pliable sheet comprising a second internal surface, a second exterior surface and a second edge, the second exterior surface to face the second building space and the first internal surface to face the second internal surface;

an intermediate piece having a first portion disposed between the first edge and the second edge;

a joint comprising a thermoplastic material of the first portion of the intermediate piece to couple the first edge of the first sheet and the second edge of the second sheet, the joint bordering an internal space defined by the first internal surface of the first sheet and the second internal surface of the second sheet;

an insulated pad disposed in the internal space between the first sheet and the second sheet, the insulated pad comprising fiber batting that includes a plurality of loops; and a touch-and-hold fastener disposed on a second portion of the intermediate piece in the internal space, the touch-and-hold fastener being spaced apart from the joint, the touch-and-hold fastener separably coupling the insulated pad to at least one of the first sheet and the second sheet, the touch-and-hold fastener incorporating the plurality of loops of the insulated pad.

23. The divider of claim 22, wherein the insulated pad includes a plurality of loops to provide a portion of the touch-and-hold fastener.

24. A divider to at least partially separate a first building space from a second building space, the divider comprising:

a flexible panel having an inner surface defining an enclosed cavity, the panel including a first sheet and a second sheet each having peripheral edges, the first and second sheets being sealed along the peripheral edges to define the enclosed cavity;

an insulated pad disposed within the cavity;

a hook-and-loop fastener disposed within the cavity to couple the insulated pad to the internal surface of the panel; and an intermediate piece coupling the hook-and-loop fastener to the panel, the intermediate piece having a first portion engaging the first sheet and the second sheet and a second portion spaced from the first and second sheets.

25. A divider of claim 24, wherein the peripheral edges of the first and second sheets are sealed without the use of joints or seams.

26. A divider of claim 24, wherein an edge of the intermediate piece is sealed along a portion of the peripheral edges of the first and second sheet.

* * * * *